US010312568B2

(12) United States Patent
Pappas

(10) Patent No.: US 10,312,568 B2
(45) Date of Patent: Jun. 4, 2019

(54) PROCESS FOR MAKING A SELF-ALIGNED WAVEGUIDE

(71) Applicant: The United States of America, as represented by the Secretary of Commerce, Washington, DC (US)

(72) Inventor: David P. Pappas, Boulder, CO (US)

(73) Assignee: THE UNITED STATES OF AMERICA, AS REPRESENTED BY THE SECRETARY OF COMMERCE, Washington, DC (US)

( * ) Notice: Subject to any disclaimer, the term of this patent is extended or adjusted under 35 U.S.C. 154(b) by 0 days.

(21) Appl. No.: 15/841,920

(22) Filed: Dec. 14, 2017

(65) Prior Publication Data

US 2019/0051966 A1 Feb. 14, 2019

Related U.S. Application Data

(60) Provisional application No. 62/542,857, filed on Aug. 9, 2017.

(51) Int. Cl.
*H01P 11/00* (2006.01)
*H01P 1/00* (2006.01)

(52) U.S. Cl.
CPC ..... *H01P 11/001* (2013.01); *H01P 1/00* (2013.01)

(58) Field of Classification Search
CPC ..... H01L 21/31056; H01L 21/31683; H01L 21/4828; H01P 11/001
See application file for complete search history.

(56) References Cited

U.S. PATENT DOCUMENTS

2002/0164884 A1* 11/2002 Lishan ..... H01L 21/28 438/739
2004/0248334 A1* 12/2004 Hoss ..... H01L 33/005 438/39

* cited by examiner

*Primary Examiner* — Duy Vu N Deo
(74) *Attorney, Agent, or Firm* — Office of Chief Counsel for National Institute of Standards and Technology

(57) ABSTRACT

A process for making a self-aligned waveguide includes: disposing a central conductor layer on a substrate; disposing a mask layer on the central conductor layer; forming a mask from the mask layer; removing a portion of the central conductor layer; forming an undercut interposed between substrate and the mask; forming a central conductor; disposing a ground conductor layer on the mask and the substrate; removing a portion of the ground conductor layer disposed on the mask; forming a ground plane conductor from the ground conductor layer in response to removing the portion of the ground conductor layer; and removing the mask to make the self-aligned waveguide in which the undercut provides self-alignment of each of the inner walls of the ground plane conductor to each of the sidewalls of the central conductor, and the ground plane conductor is electrically isolated from the central conductor.

12 Claims, 25 Drawing Sheets

PROCESS FOR MAKING A SELF-ALIGNED WAVEGUIDE

CROSS REFERENCE TO RELATED APPLICATIONS

This application claims the benefit of U.S. Provisional Patent Application Ser. No. 62/542,857 filed Aug. 9, 2017, the disclosure of which is incorporated herein by reference in its entirety.

STATEMENT REGARDING FEDERALLY SPONSORED RESEARCH

This invention was made with United States Government support from the National Institute of Standards and Technology (NIST), an agency of the United States Department of Commerce, and under Agreement No. IARPA-16002-D2017-1706230008 awarded by IARPA. The Government has certain rights in the invention. Licensing inquiries may be directed to the Technology Partnerships Office, NIST, Gaithersburg, Md., 20899; voice (301) 301-975-2573; email tpo@nist.gov; reference NIST Docket Number 17-031US1.

BRIEF DESCRIPTION

Disclosed is a process for making a self-aligned waveguide, the process comprising: disposing a central conductor layer on a substrate, the central conductor layer comprising niobium and being electrically conductive; disposing a mask layer on the central conductor layer such that the central conductor layer is interposed between the substrate and the mask layer; forming a mask from the mask layer; producing an exposed portion of the central conductor layer in response to forming the mask; removing a portion of the central conductor layer; forming an undercut interposed between substrate and the mask in response to removing a portion of the central conductor layer; forming a central conductor from the central conductor layer in response to removing a portion of the central conductor layer, the central conductor bordering the undercut at a plurality of sidewalls of the central conductor, and the central conductor being interposed between the mask and the substrate; disposing a ground conductor layer on the mask and the substrate such that an inter-electrode gap is interposed between the sidewalls of the central conductor and inner walls of the ground conductor layer, the ground conductor layer comprising niobium and being electrically conductive; removing a portion of the ground conductor layer disposed on the mask to expose a surface of the mask; forming a ground plane conductor from the ground conductor layer in response to removing the portion of the ground conductor layer; and removing the mask to make the self-aligned waveguide in which the undercut provides self-alignment of each of the inner walls of the ground plane conductor to each of the sidewalls of the central conductor, and the ground plane conductor is electrically isolated from the central conductor.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments is presented herein by way of exemplification and not limitation.

It has been discovered that a self-aligned waveguide and process for making the self-aligned waveguide provide a coplanar waveguide (CPW) with a continuous, self-aligned gap between a center trace and a ground plane. This forms CPWs using materials with an etch that creates an undercut under a mask. To remove the mask, that lowers loss, materials can be used for the centerline that are not affected by the process used to remove the resist. When the centerline is narrow and thin or made of a superconducting material, the gap can be made very narrow. This counteracts high impedance due to kinetic inductance of thin and narrows a superconducting center trace such that the self-aligned process provides an improved yield during fabrication relative to conventional methods, lowers the total impedance of the CPW, and aids impedance match.

Figure 1:
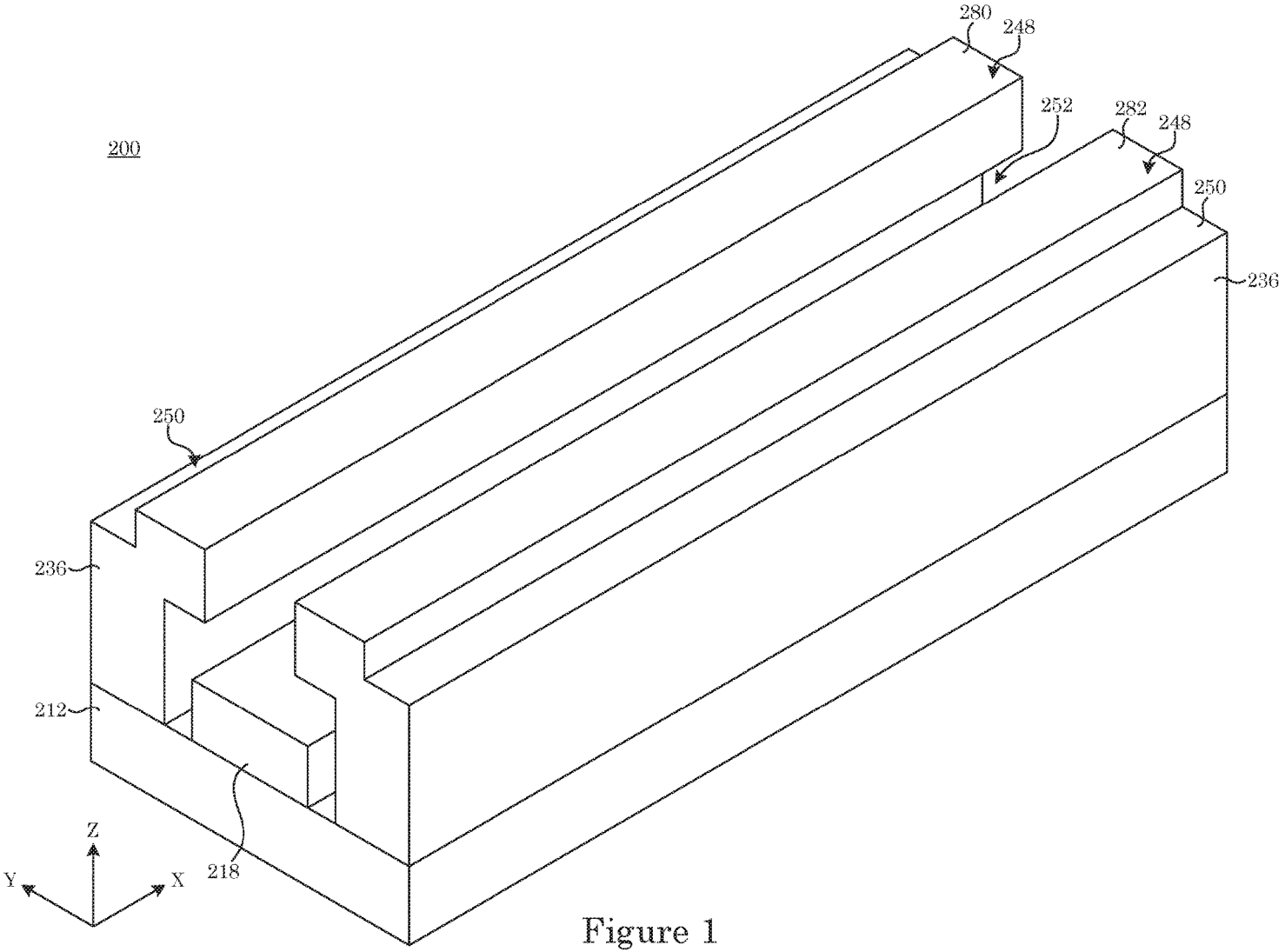
FIG. 1 shows a perspective view of a self-aligned waveguide.
Figure 2:
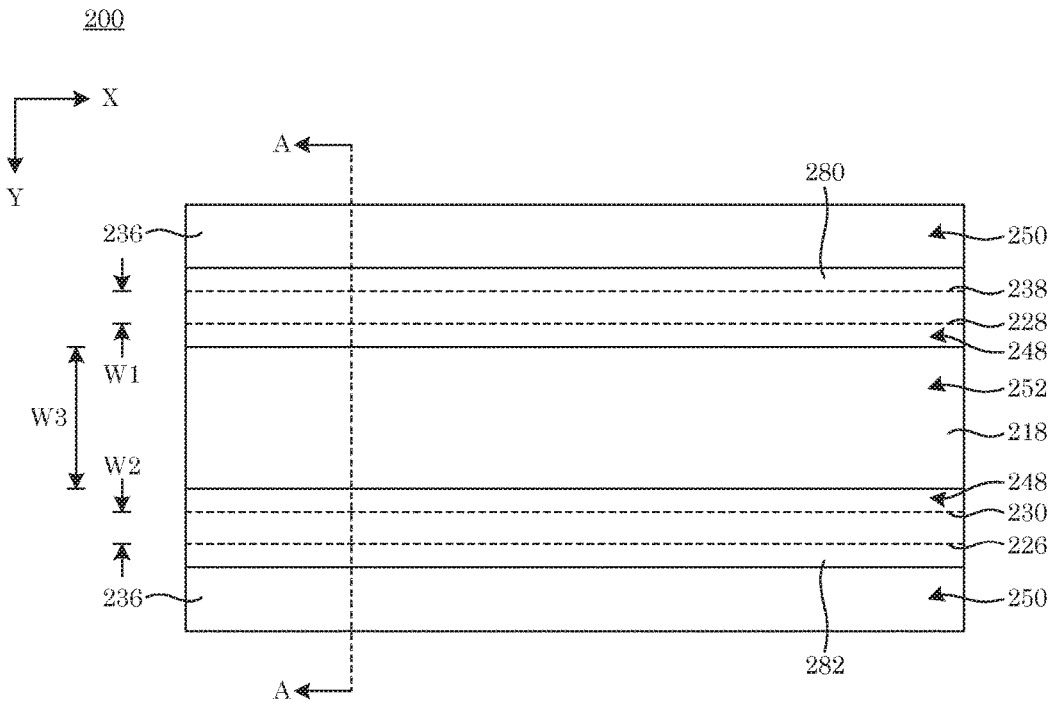
FIG. 2 shows a top view of the self-aligned waveguide shown in FIG. 1.
Figure 3:
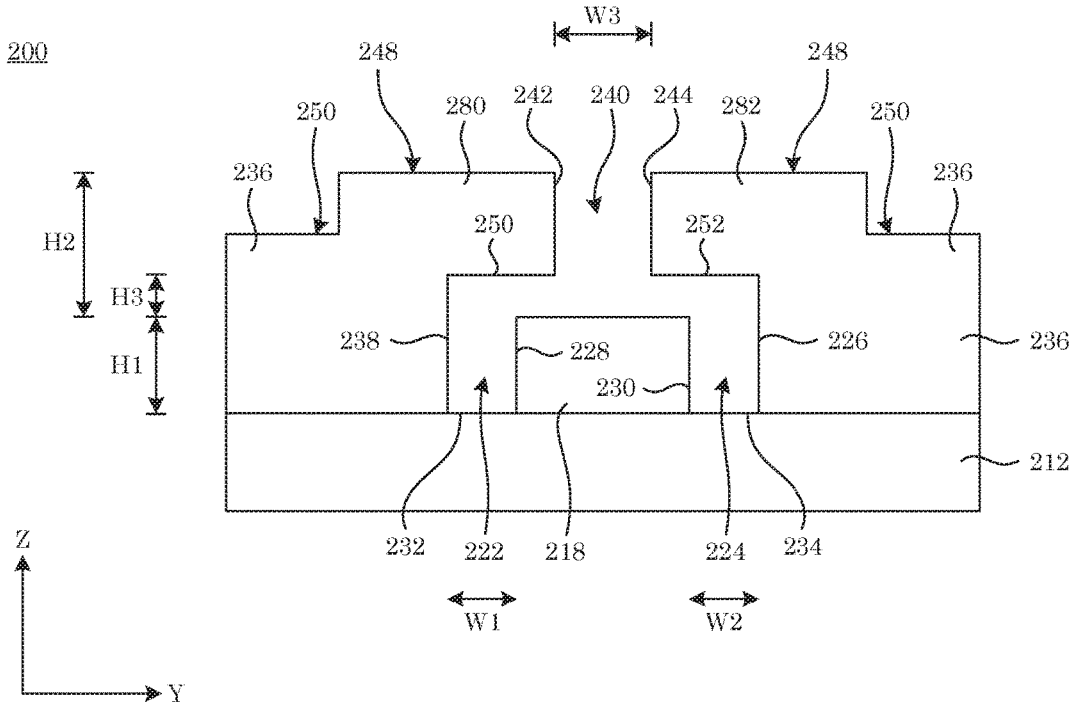
FIG. 3 shows a cross-section along line A-A of the self-aligned waveguide shown in FIG. 2.
Figure 4:
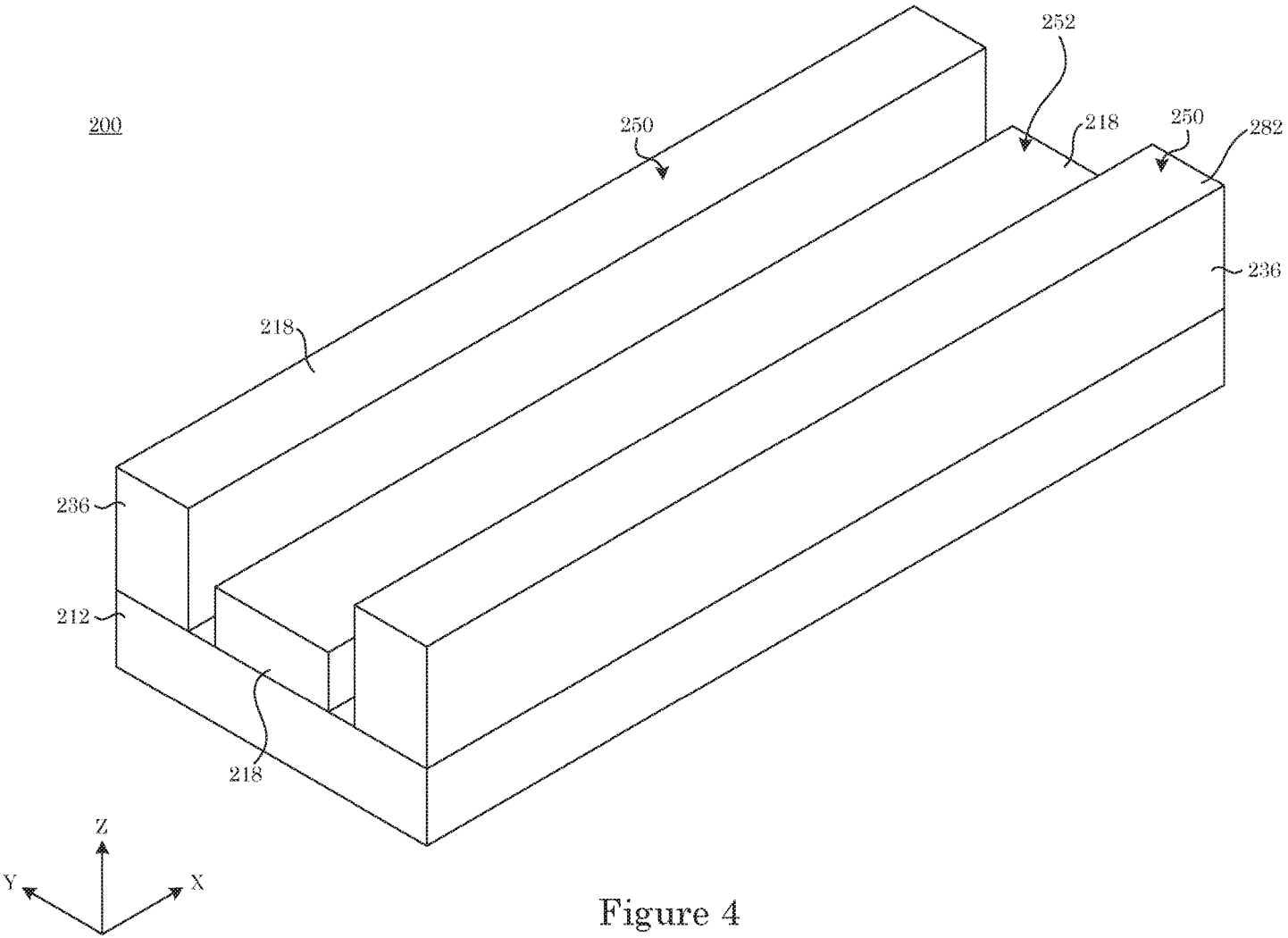
FIG. 4 shows a perspective view of a self-aligned waveguide.
Figure 5:
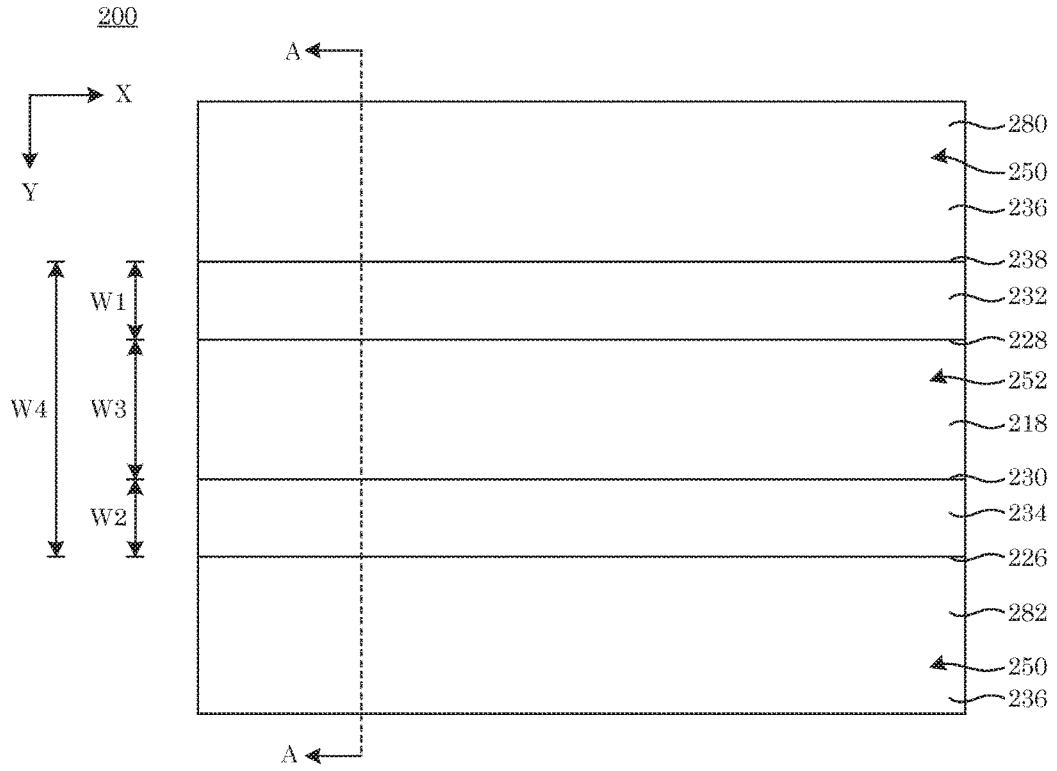
FIG. 5 shows a top view of the self-aligned waveguide shown in FIG. 4.
Figure 6:
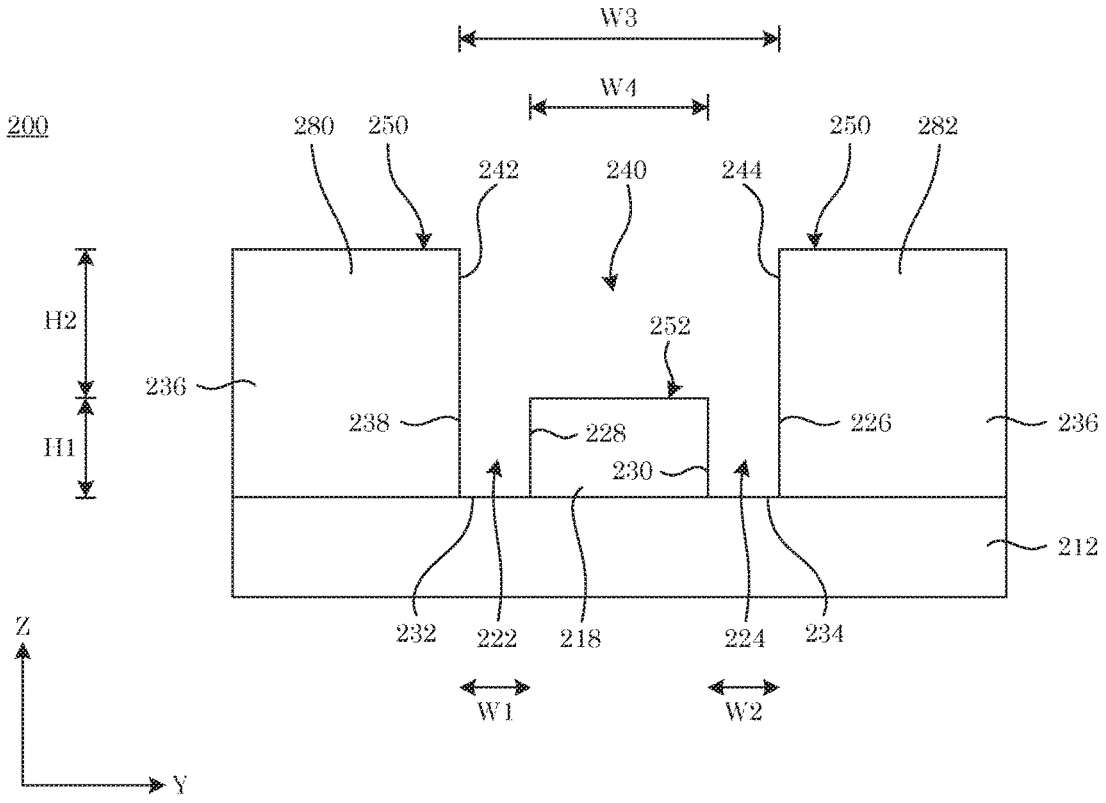
FIG. 6 shows a cross-section along line A-A of the self-aligned waveguide shown in FIG. 5.

In an embodiment, with reference to FIG. 1, FIG. 2, FIG. 3, FIG. 4, FIG. 5, and FIG. 6, self-aligned waveguide 200 includes: substrate 212; central conductor 218 disposed on substrate 212; and ground plane conductor 236 disposed on substrate 212. Here, central conductor 218 and ground plane conductor 236 are spaced apart by inter-electrode gaps (222, 224). Ground plane conductor 236 includes first rail 280 and second rail 282 spaced apart by intra-electrode gap 240 having third width W3. Intra-electrode gap 240 is bounded by wall 242 of first rail 280 and wall 244 of second rail 282.

Intra-electrode gap 240 extends from a plane provided by surfaces 248 of first rail 280 and second rail 282 of ground plane conductor 236 to surface 252 of central conductor 218. Further, inter-electrode gap 222 is bounded by sidewall 228 of central conductor 218, surface 232 of substrate 212, inner wall 238 of first rail 280 of ground plane conductor 236 and has first width W1 between inner wall 238 and sidewall 228. Inter-electoral gap 224 is bounded by sidewall 230 of central conductor 218, surface 234 of substrate 212, inner wall 226 of second rail 282 of ground plane conductor 236 and has second width W2 between inner wall 226 and sidewall 230. Moreover, substrate surface (232, 234) is separated from surface 252 of central conductor 218 by first height H1. Surface 252 of central conductor 218 is separated from surface 248 of ground plane conductor 236 by second height 112. It should be appreciated that inter-electrode gaps (222, 224) provide self-alignment of central conductor 218 relative to first rail 280 and second rail 282 of ground plane conductor 236.

In an embodiment, ground plane conductor 236 includes wall 251 of first rail 280 and wall 252 of second rail 282, wherein wall (251, 252) is separated from surface 252 of central conductor 218 by third height 113.

According to an embodiment, ground plane conductor 236 includes surface 250 that is offset by a step edge from surface 248.

Figure 7:
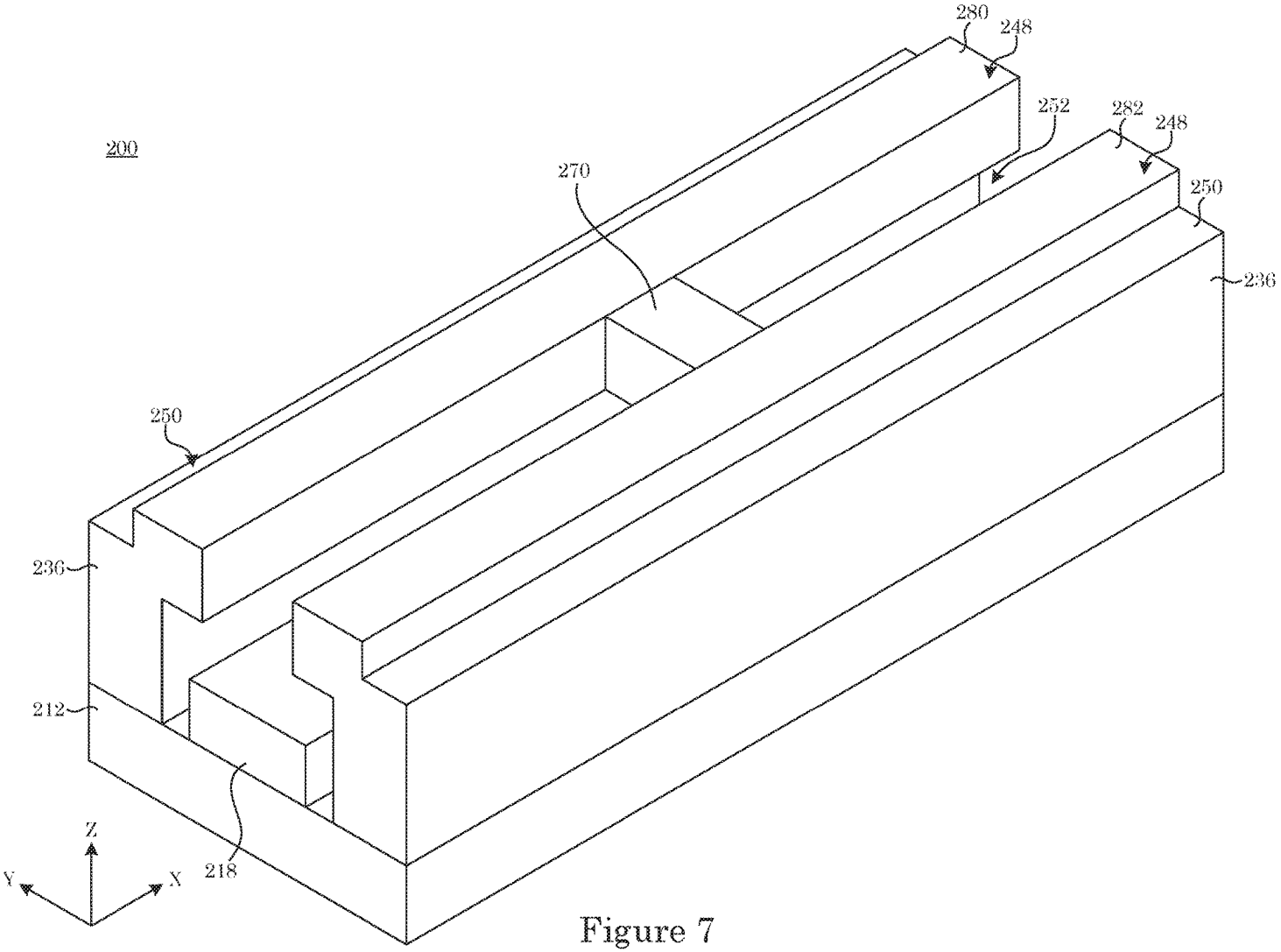
FIG. 7 shows a perspective view of a self-aligned waveguide.
Figure 8:
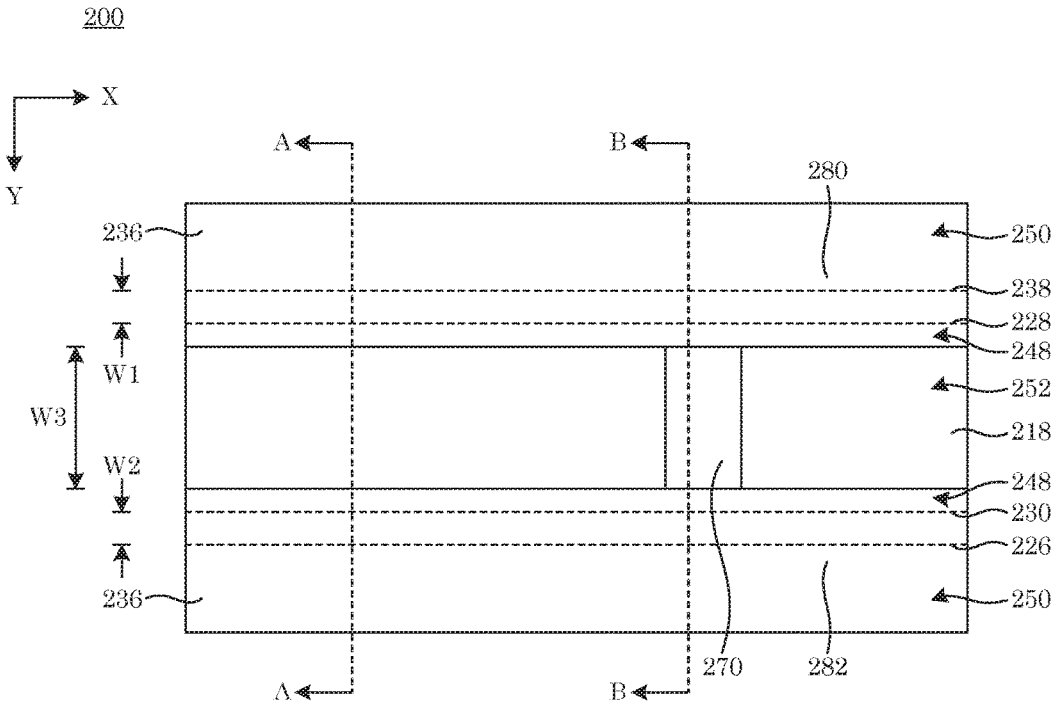
FIG. 8 shows a top view of the self-aligned waveguide shown in FIG. 7.
Figure 9:
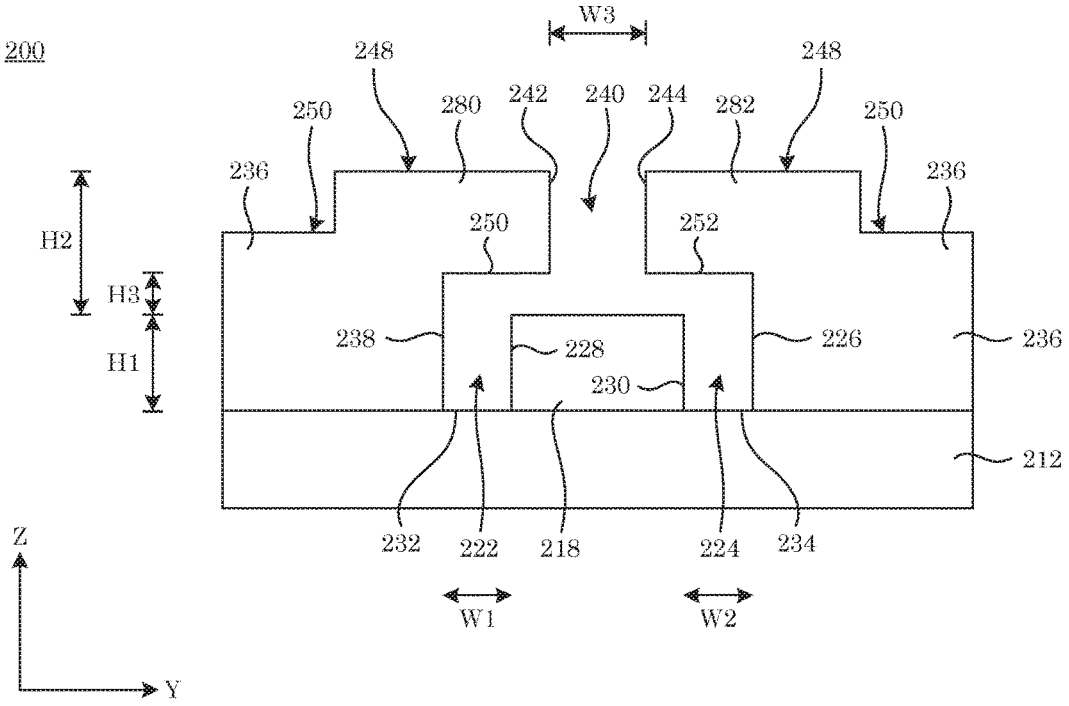
FIG. 9 shows a cross-section along line A-A of the self-aligned waveguide shown in FIG. 8.
Figure 10:
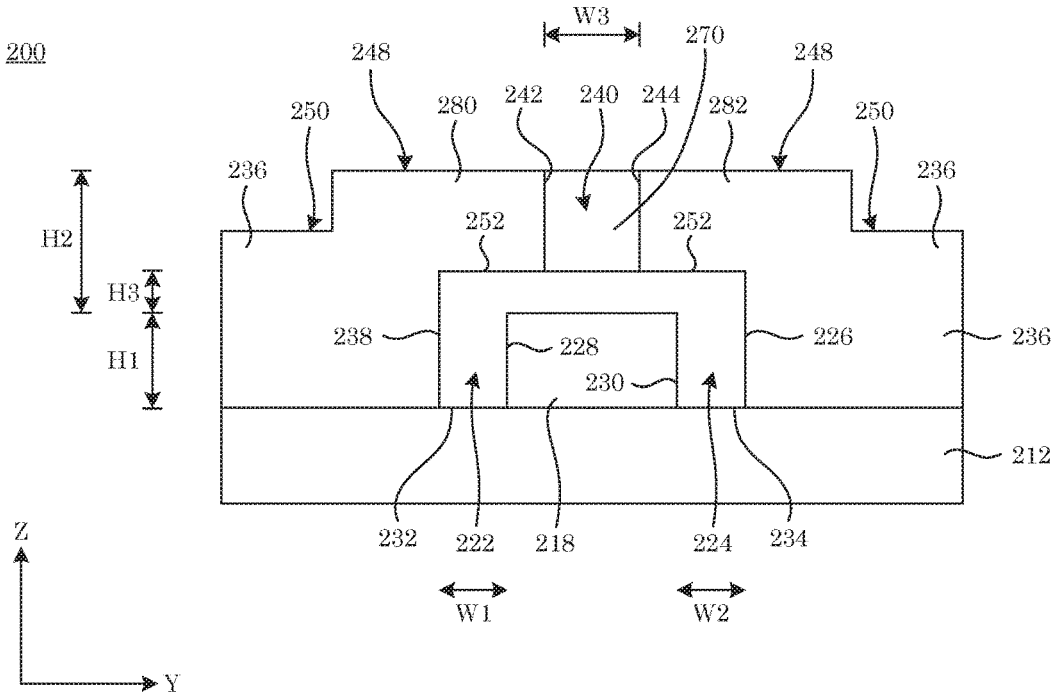
FIG. 10 shows a cross-section along line B-B of the self-aligned waveguide shown in FIG. 8.
Figure 11:
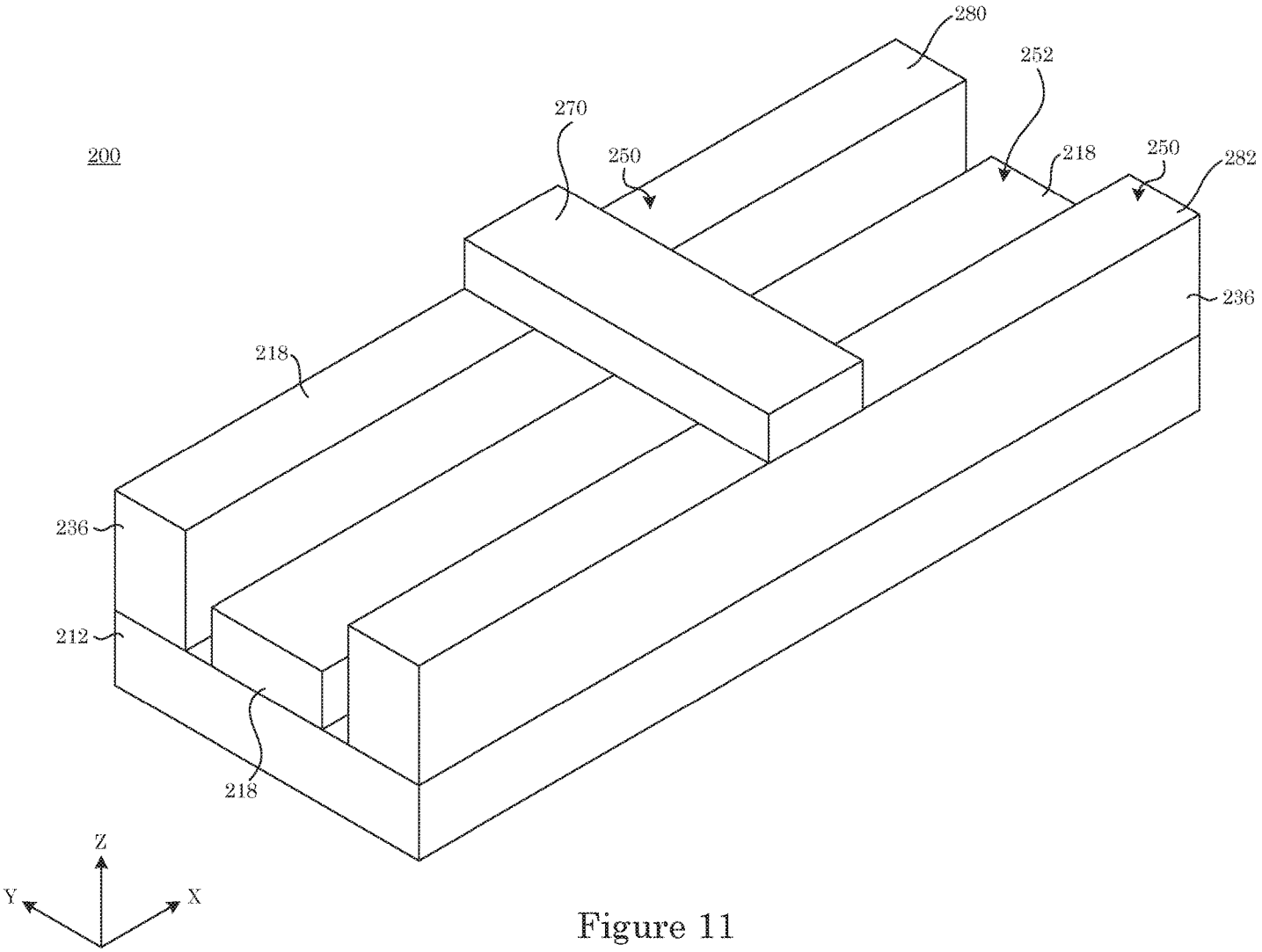
FIG. 11 shows a perspective view of a self-aligned waveguide.
Figure 12:
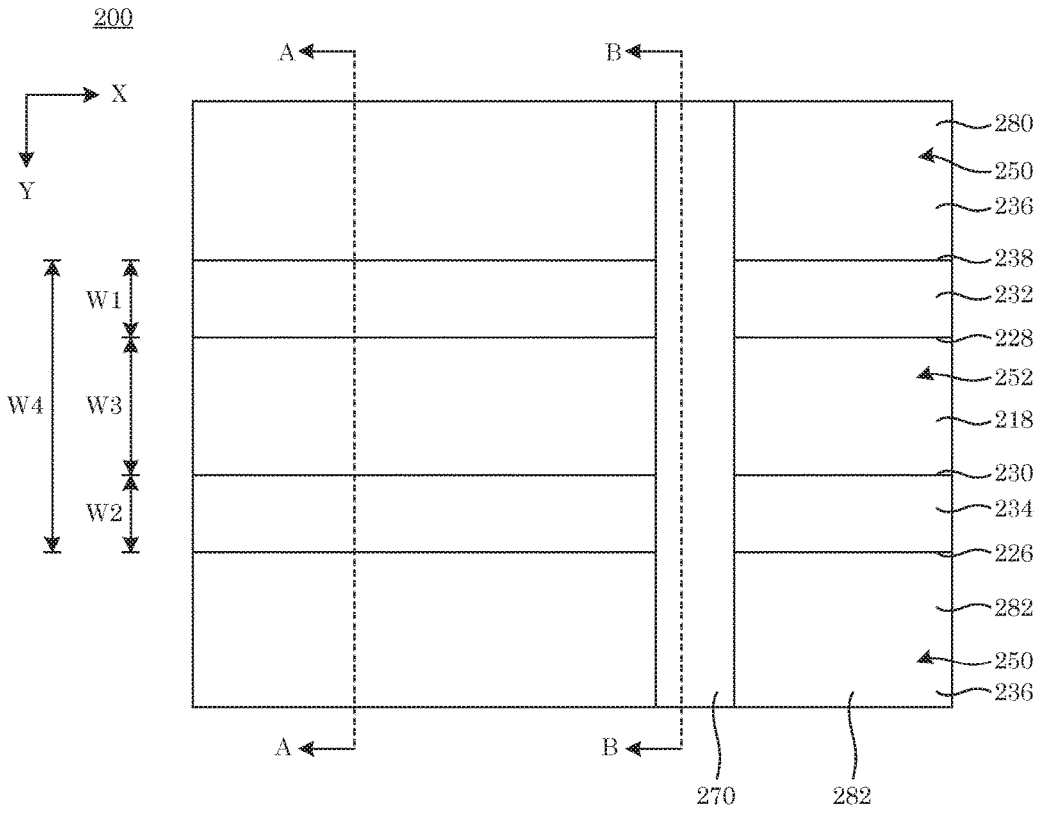
FIG. 12 shows a top view of the self-aligned waveguide shown in FIG. 11.
Figure 13:
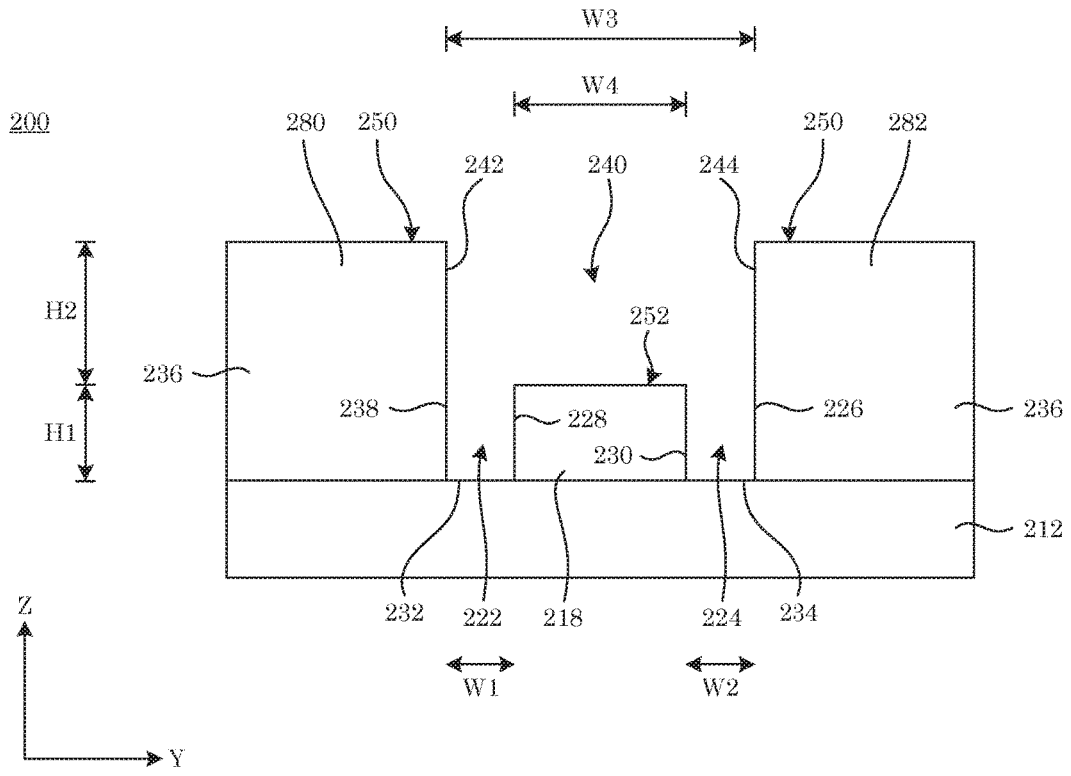
FIG. 13 shows a cross-section along line A-A of the self-aligned waveguide shown in FIG. 12.
Figure 14:
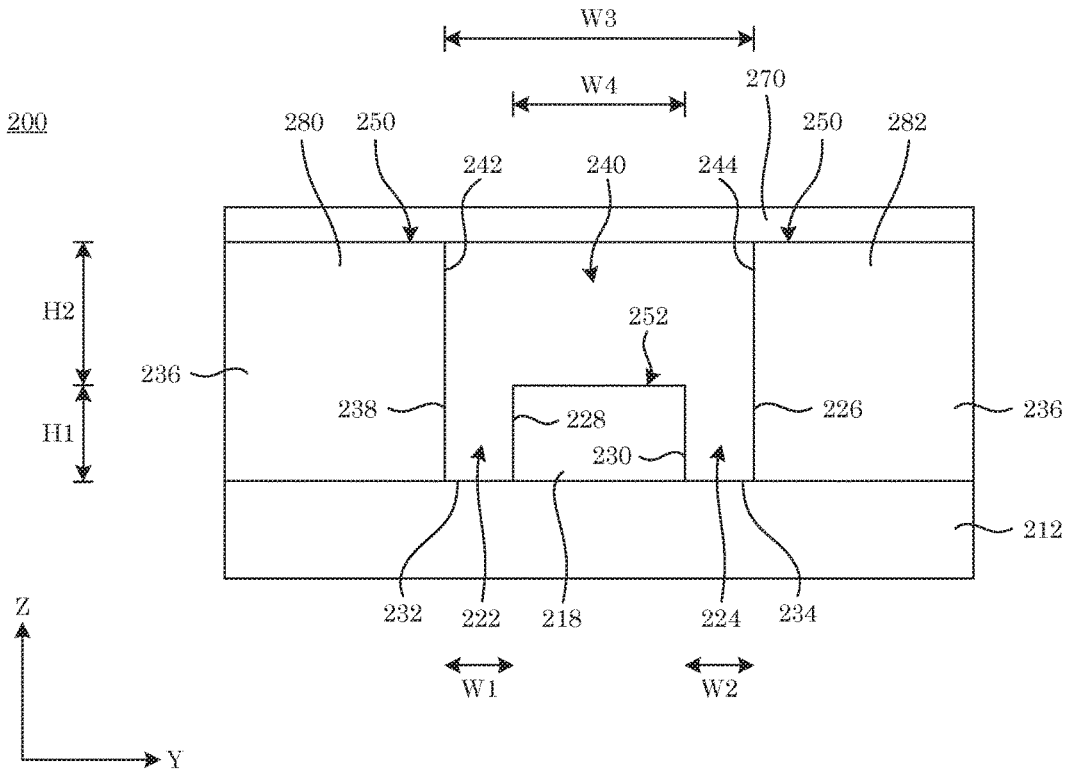
FIG. 14 shows a cross-section along line B-B of the self-aligned waveguide shown in FIG. 12.
Figure 15:
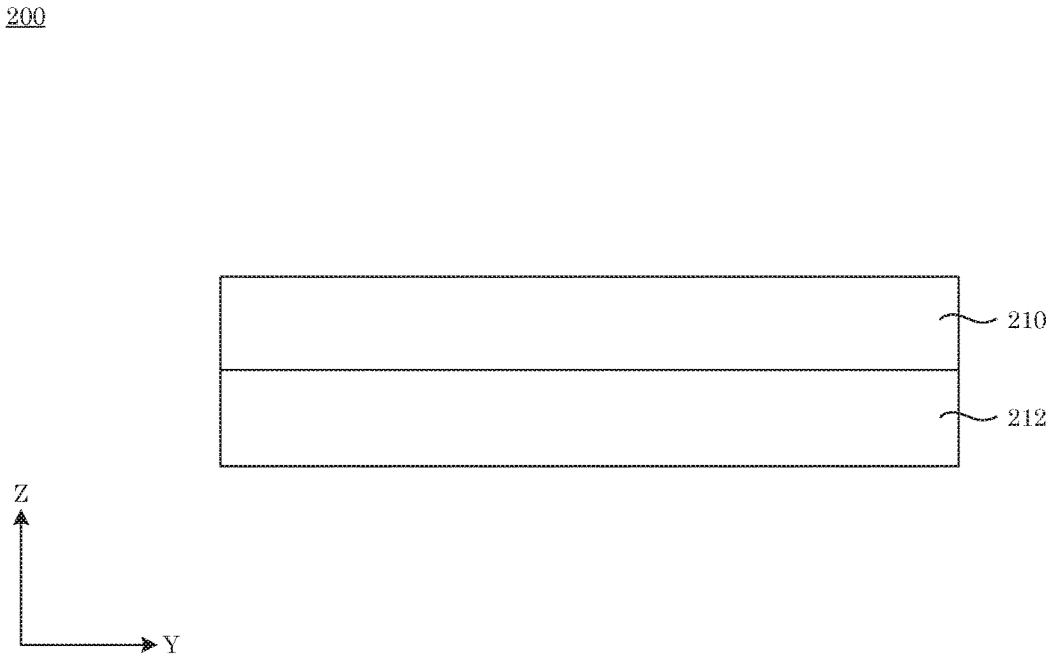
FIG. 15 shows steps in forming a self-aligned waveguide.
Figure 16:
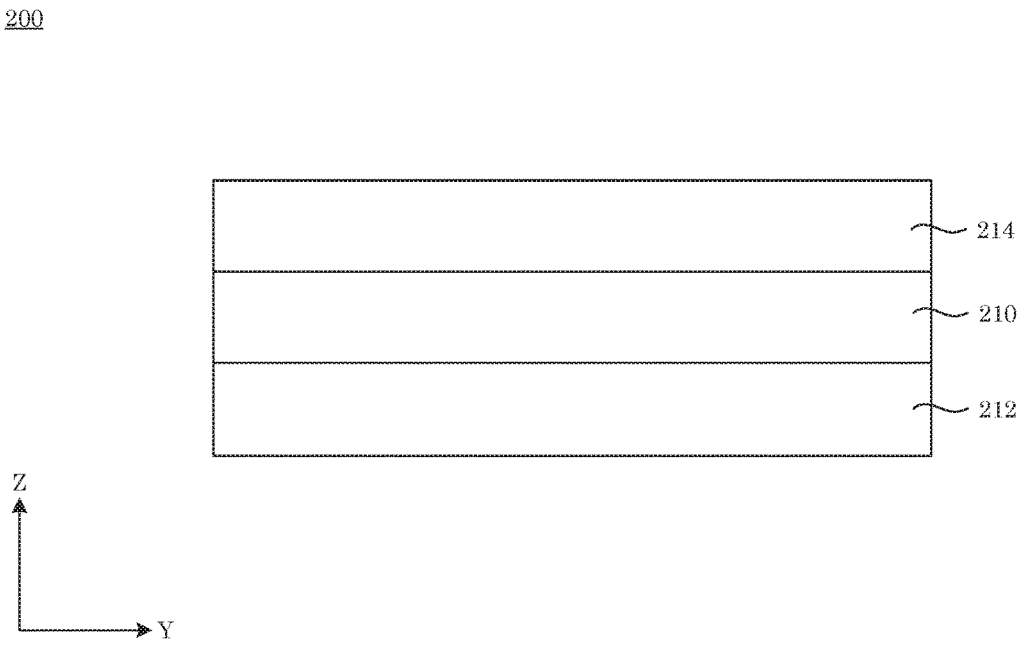
FIG. 16 shows steps in forming a self-aligned waveguide.
Figure 17:
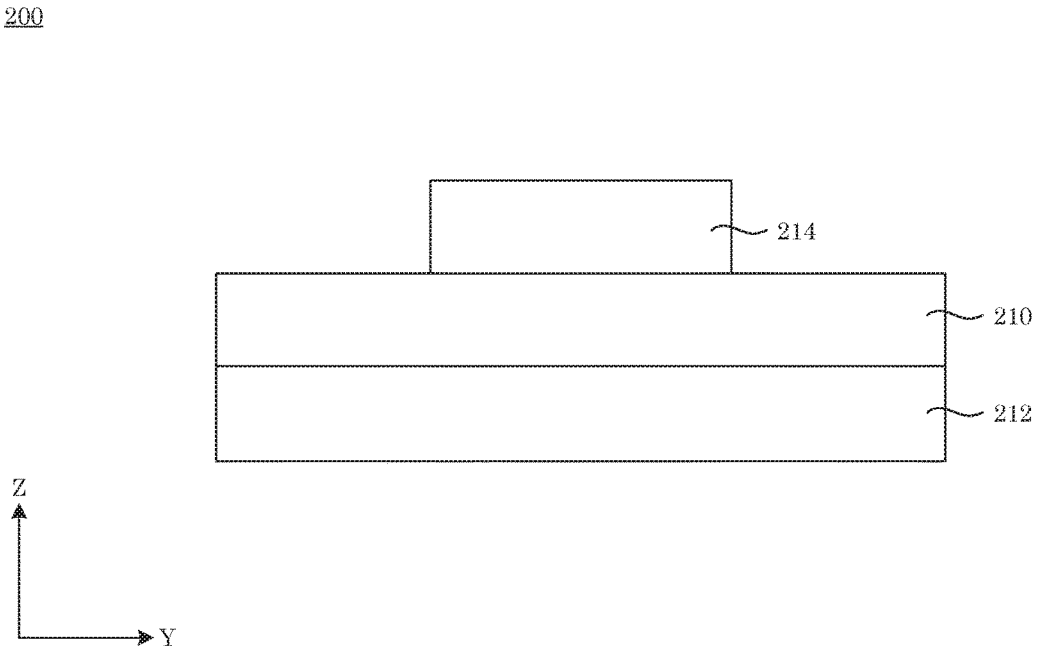
FIG. 17 shows steps in forming a self-aligned waveguide.
Figure 18:
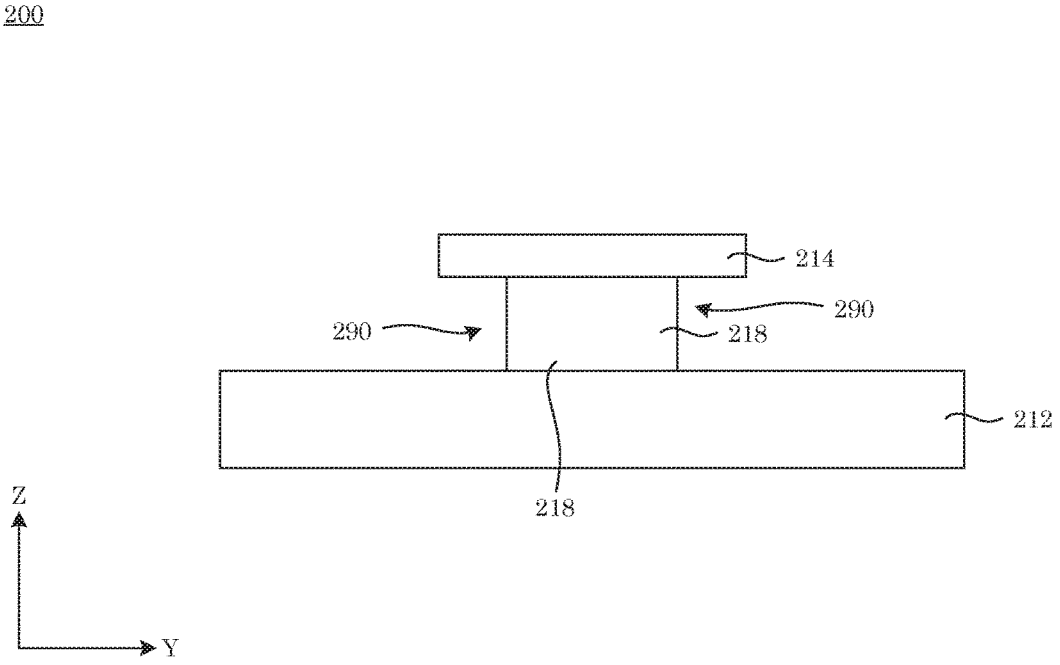
FIG. 18 shows steps in forming a self-aligned waveguide.
Figure 19:
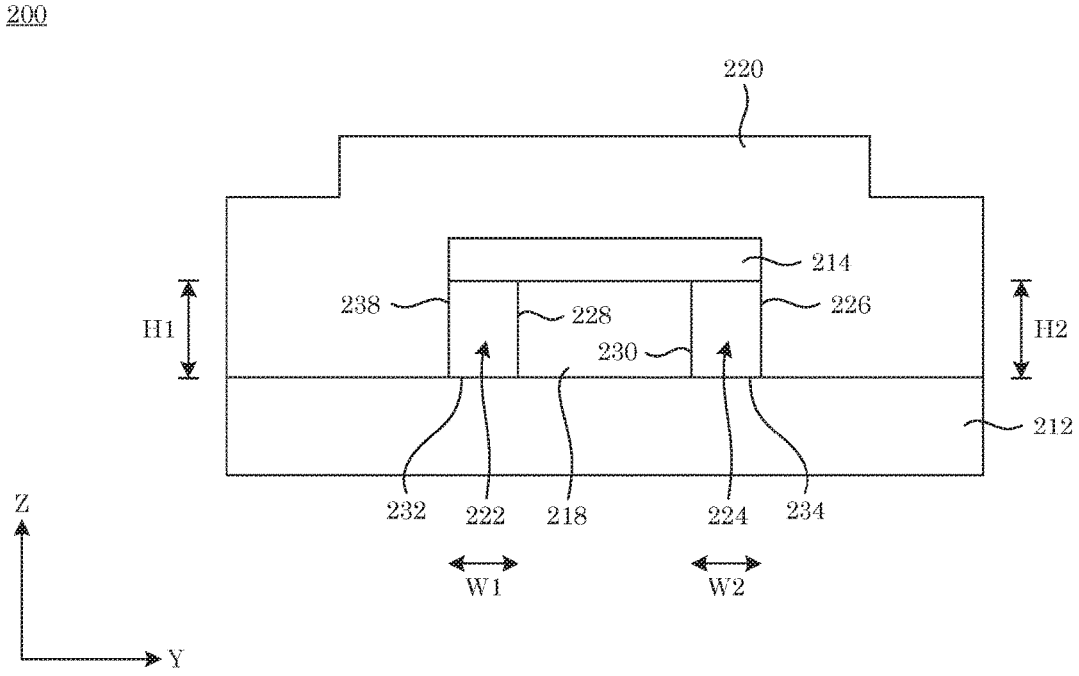
FIG. 19 shows steps in forming a self-aligned waveguide.
Figure 20:
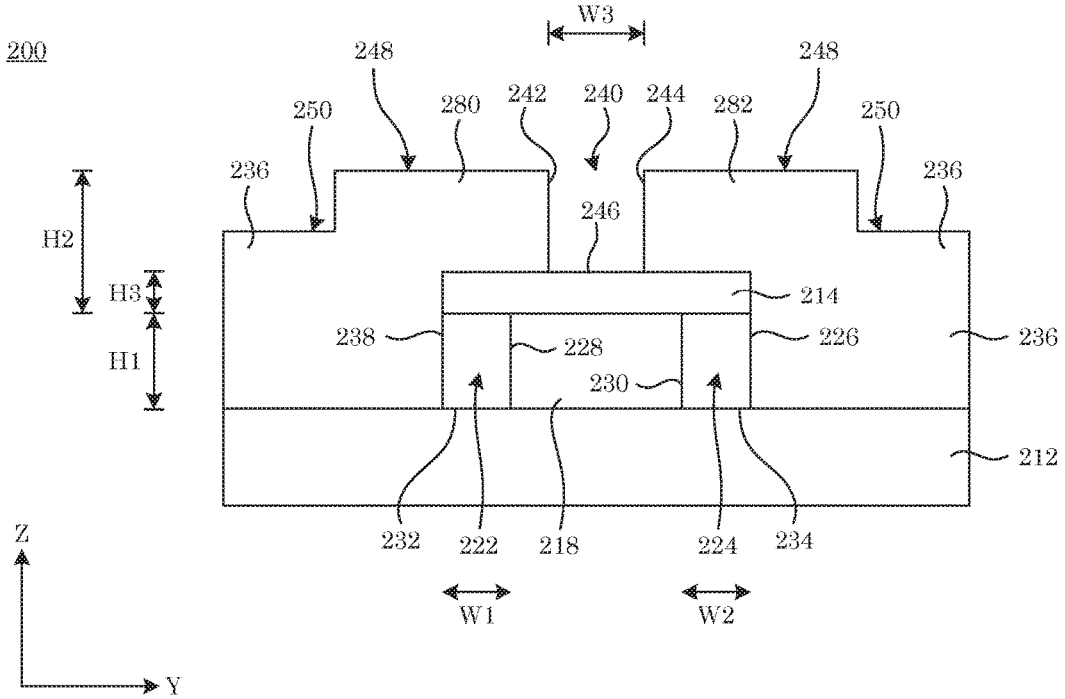
FIG. 20 shows steps in forming a self-aligned waveguide.
Figure 21:
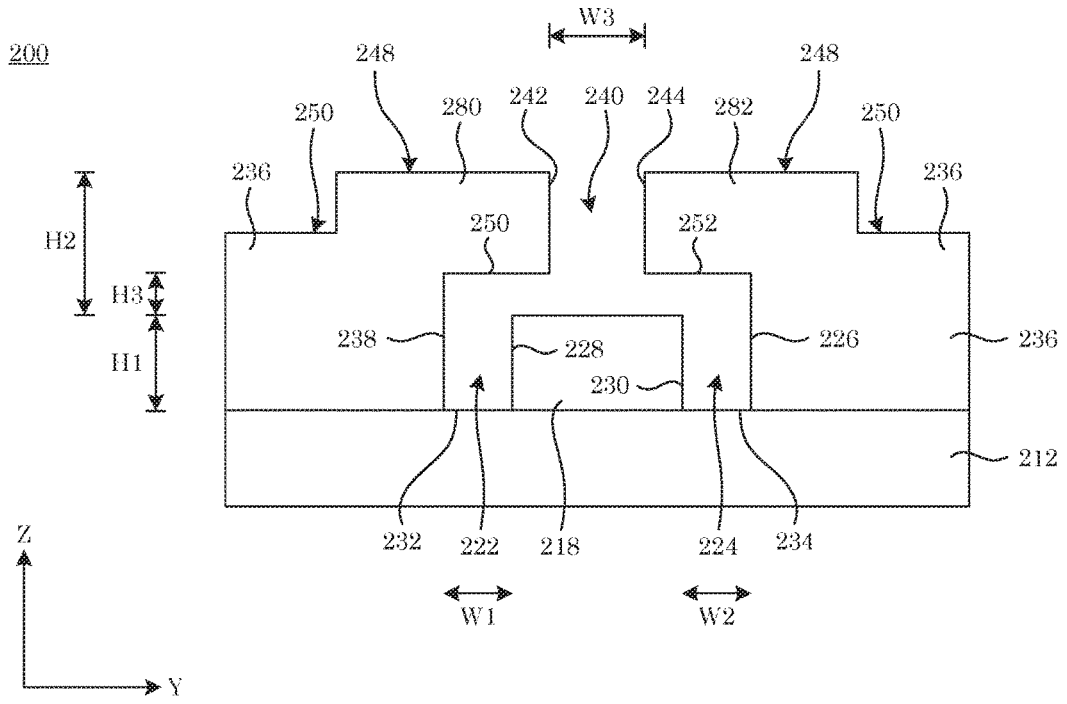
FIG. 21 shows steps in forming a self-aligned waveguide.
Figure 22:
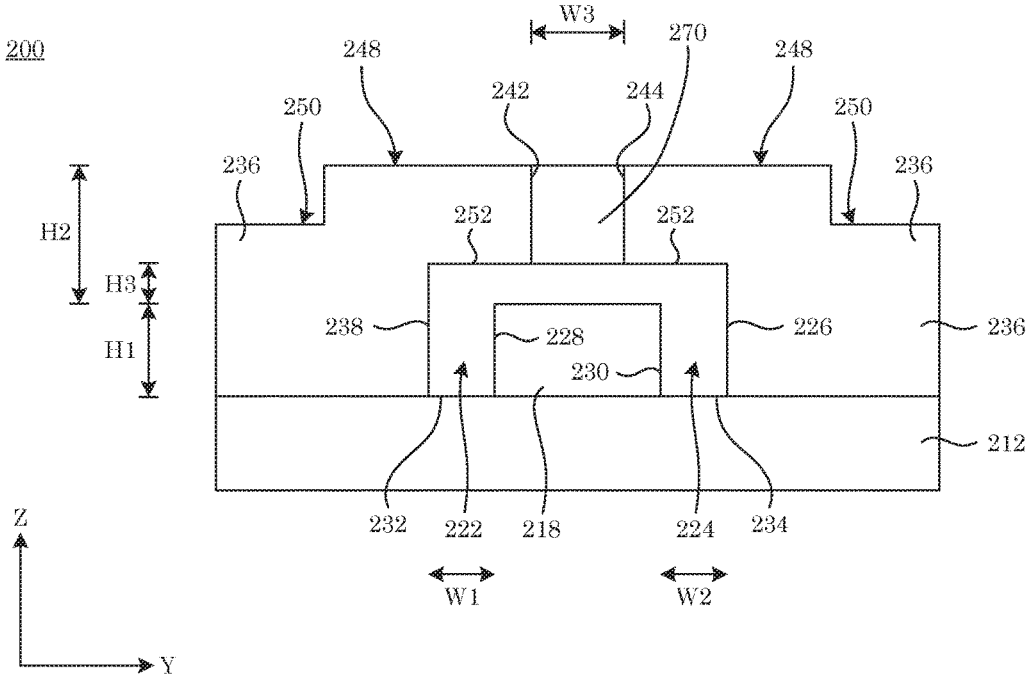
FIG. 22 shows steps in forming a self-aligned waveguide.
Figure 23:
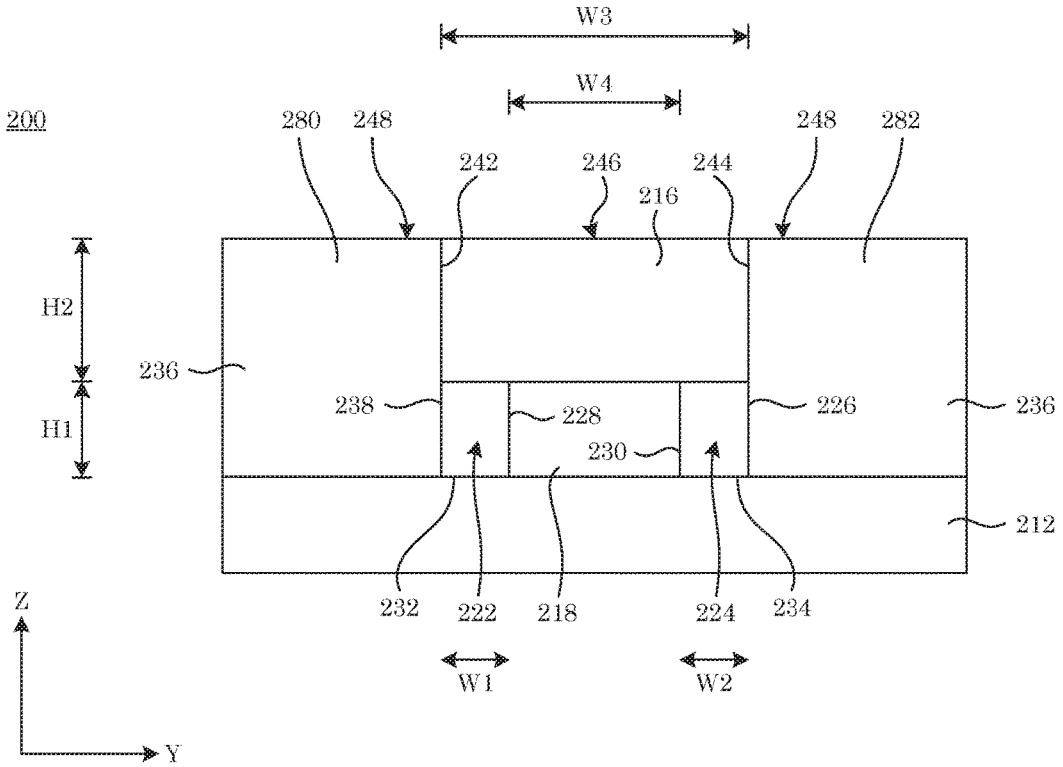
FIG. 23 shows steps in forming a self-aligned waveguide.
Figure 24:
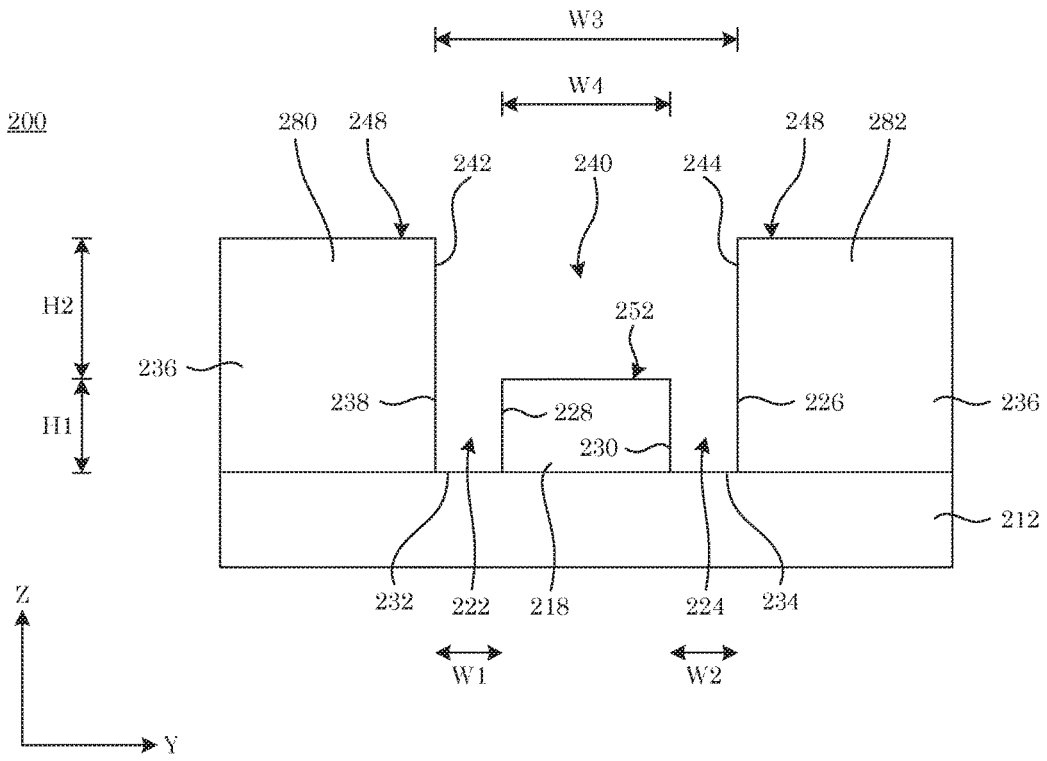
FIG. 24 shows steps in forming a self-aligned waveguide.
Figure 25:
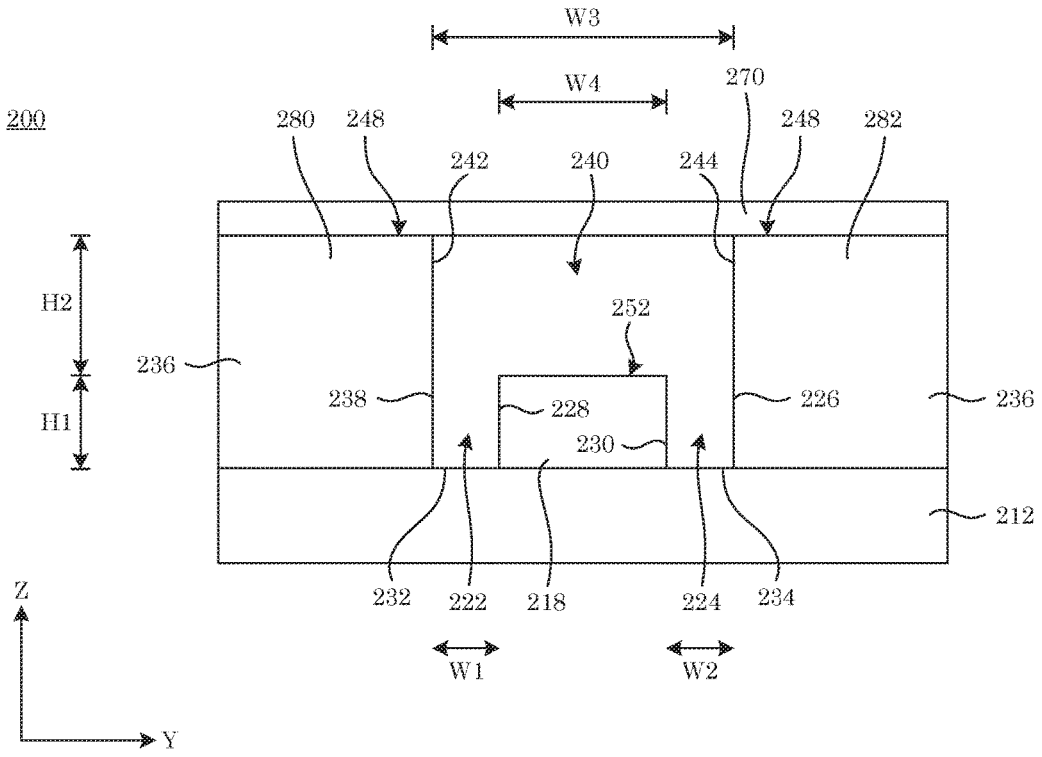
FIG. 25 shows steps in forming a self-aligned waveguide.

In an embodiment, with reference to FIG. 7, FIG. 8, FIG. 9, FIG. 10, FIG. 11, FIG. 12, FIG. 13, and FIG. 14, self-aligned waveguide 200 includes: substrate 212; central conductor 218 disposed on substrate 212; and ground plane conductor 236 disposed on substrate 212. Here, central conductor 218 and ground plane conductor 236 are spaced apart by inter-electrode gaps (222, 224). Ground plane conductor 236 includes first rail 280 and second rail 282 spaced apart by intra-electrode gap 240 having third width W3. Intra-electrode gap 240 is bounded by wall 242 of first rail 280 and wall 244 of second rail 282. Intra-electrode gap 240 extends from a plane provided by surfaces 248 of first rail 280 and second rail 282 of ground plane conductor 236 to surface 252 of central conductor 218. Further, inter-electrode gap 222 is bounded by sidewall 228 of central conductor 218, surface 232 of substrate 212, inner wall 238 of first rail 280 of ground plane conductor 236 and has first width W1 between inner wall 238 and sidewall 228. Inter-electoral gap 224 is bounded by sidewall 230 of central conductor 218, surface 234 of substrate 212, inner wall 226 of second rail 282 of ground plane conductor 236 and has second width W2 between inner wall 226 and sidewall 230. Moreover, substrate surface (232, 234) is separated from surface 252 of central conductor 218 by first height H1. Surface 252 of central conductor 218 is separated from surface 248 of ground plane conductor 236 by second height H2. It should be appreciated that inter-electrode gaps (222, 224) provide self-alignment of central conductor 218 relative to first rail 280 and second rail 282 of ground plane conductor 236. Cross over 270 is disposed on surface 248 of first rail 280 and second rail 282 of ground plane conductor. In this manner, cross over 270 electrically interconnects first rail 280 and second rail 282.

It is contemplated that central conductor layer 210 can include a conductive material to be patterned into a conductive strip and can be a metal, wherein the metal is an electrical conductor or superconducting metal. Moreover, the material can be etched to form an undercut underneath edges of the mask layer without removing the mask.

In self-aligned waveguide 200, substrate 212 can include a planar surface to support the central conductor and ground conductor and can be an element that electrically insulates and is resistant to the etches used to pattern the central conductor and mask layer.

In self-aligned waveguide 200, mask layer 214 can include a film that is deposited on top of the central conductor layer to be patterned into a mask above the central conductor and subsequently to define the gap between the central conductor and the ground planes and can be material that can be patterned. Moreover, mask layer 214 is insulating and can include a material that can be removed without affecting the material used for the central conductor and ground conductor layers.

In self-aligned waveguide 200, mask 216 can include structure that has been patterned into a structure wider than the desired width of the central conductor by twice the gap to act as a mask above the central conductor and subsequently to define the gap between the central conductor and the ground planes and can be material that can be patterned. Moreover, mask 216 is insulating if it is not removed from the final structure or can include a material that can be removed without affecting material used for the central conductor and ground conductor layers.

In self-aligned waveguide 200, central conductor 218 can include a conductive strip to carry current and AC signals and can be a metal, normal or superconducting. Moreover, the material should be able to be etched to form an undercut underneath the edges of the mask layer without removing the mask.

In self-aligned waveguide 200, ground conductor layer 220 can include layer of material to form a ground plane and can be a conductive material either normal or superconducting. Moreover, ground conductor layer 220 can be deposited on top of the substrate and mask layer without depositing into the undercut so far as to make contact to the central conductor. Further, ground conductor layer 220 is removable without completely removing the mask.

In self-aligned waveguide 200, inter-electrode gap 222 and 224 can include open spaces to create an insulating space between the central conductor and the ground planes and can be vacuum or air.

In self-aligned waveguide 200, inner wall 226 and 238 can include the bottom interface of the ground conductor layers to provide the capacitance of the ground plane to the center conductor and can be metal. Moreover, inner wall 226 and 238 can be superconducting or normal to resist the process used to remove the mask if the mask will be removed.

In self-aligned waveguide 200, sidewalls 228 and 230 can include the etched edge of the central conductor to define capacitance of the central conductor to ground and can be metal. Moreover, sidewalls 228 and 230 can be electrically conductive or superconducting and should resist the process used to remove the mask if the mask is to be removed.

In self-aligned waveguide 200, surface 232 and 234 can include surface of the substrate to separate the central conductor from the grounds and can be planar. Moreover, surface 232 and 234 are electrically insulating.

In self-aligned waveguide 200, intra-electrode gap 240 can include a space between the ground electrode on the either side of the central conductor to allow access to remove the mask layer and can be air or vacuum. Moreover, intra-electrode gap 240 can be formed without affecting the central conductor.

In self-aligned waveguide 200, surface 248 can include the surface of the ground plane that is raised due to being deposited on top of the mask layer to be a ground plane and can be metal. Moreover, surface 248 superconducting or an electrically conductive metal.

In self-aligned waveguide 200, surface 250 can include the surface of the ground plane that is not above the mask layer to form the ground plane and can be metal. Moreover, surface 250 can be electrically conductive or superconducting.

In self-aligned waveguide 200, cross over 270 can include material that is not removed to connect the ground planes on either side of the central conductor and can be metal. Moreover, cross over 270 can be electrically conductive or superconducting and resistant to the process used to remove the mask if the mask is to be removed.

In self-aligned waveguide 200, first rail 280 and 282 can include planar material to form ground on either side of the central conductor and can be metal. Moreover, first rail 280 and 282 can be electrically conductive or superconducting and resistant to the process used to remove the mask if the mask is to be removed.

In self-aligned waveguide 200, first height H1, second height H2, and third height H3 provide a separation to electrically isolate elements of self-aligned waveguide 200. Further, H1 is the thickness of the central conductor, H3 is the thickness of the mask, and H2 is the thickness of the central conductor added to the thickness of the mask. The thicknesses of the materials are selected for an impedance and manufacturability for applications.

In self-aligned waveguide 200, first width W1, second width W2, third width W3, and fourth W4 provide a separation to electrically isolate elements of self-aligned waveguide 200. Moreover, first width W1, second width W2 are provided by an amount of undercut that occurs when the central conductor is etched. Third width W3 is the width of the central conductor and fourth W4, is just the sum of W1+W2+W3. These widths together provide the capacitance per unit length. The width W3 combined with H2 will provide the inductance per unit length. Additionally, first width W1, second width W2, third width W3, and H2 can be changed independently for a selected characteristic impedance.

In an embodiment, a process for making self-aligned waveguide 200 includes disposing central conductor layer 210 on substrate 212, central conductor layer 210 being electrically conductive; disposing mask layer 214 on central conductor layer 210 such that central conductor layer 210 is interposed between substrate 212 and mask layer 214; forming mask 216 from mask layer 214; producing an exposed portion of central conductor layer 210 in response to forming mask 216; removing a portion of central conductor layer 210; forming undercut 290 interposed between substrate 212 and mask 216 in response to removing the portion of central conductor layer 210; forming central conductor 218 from central conductor layer 210 in response to removing the portion of central conductor layer 210, central conductor 218 bordering undercut 290 at a plurality of sidewalls (228, 230) of central conductor 218, and central conductor 218 being interposed between mask 216 and substrate 212; disposing ground conductor layer 220 on mask 216 and substrate 212 such that inter-electrode gap (222, 224) is interposed between sidewalls (228, 230) of central conductor 218 and inner walls (238, 226) of ground conductor layer 220, ground conductor layer 220 being electrically conductive; removing a portion of ground conductor layer 220 disposed on mask 216 to expose a surface of mask 216; forming ground plane conductor 236 from ground conductor layer 220 in response to removing the portion of ground conductor layer 220; and removing mask 216 to make self-aligned waveguide 200 in which undercut 290 provides self-alignment of each of inner walls (226, 238) of ground plane conductor 236 to each of sidewalls (228, 230) of central conductor 216, and ground plane conductor 236 is electrically isolated from central conductor 216.

The process for making self-aligned waveguide 200 further can include forming, prior to removing the portion of ground conductor layer 220 disposed on mask 216 to expose surface 252 of mask 216, intra-electrode gap 240 in ground plane conductor 236 in response to removing the portion of ground conductor layer 220.

The process for making self-aligned waveguide 200 further can include forming, after removing the portion of ground conductor layer 220 disposed on mask 216 to expose surface 252 of mask 216, intra-electrode gap 240 in ground plane conductor 236 in response to removing the portion of ground conductor layer 220.

The process for making self-aligned waveguide 200 further can include disposing cross over layer 292 on ground plane conductor 220, cross over layer 292 being electrically conductive.

The process for making self-aligned waveguide 200 further can include removing a portion of cross over layer 292; and forming cross over 270, from cross over layer 292, disposed on ground plane conductor 220 in response to removing the portion of cross over layer 292.

Disposing central conductor layer 210 on substrate 212 includes evaporating, sputtering, electrodeposition, PECVD, ALD, or the like that forms a layer that adheres to the substrate.

Disposing mask layer 214 on central conductor layer 210 such that central conductor layer 210 is interposed between substrate 212 and mask layer 214 includes evaporating, sputtering, electrodeposition, PECVD, ALD, or the like to form a layer that adheres to the substrate.

Forming mask 216 from mask layer 214 includes by lithography to expose material of mask 216 to be removed.

Producing an exposed portion of central conductor layer 210 in response to forming mask 216 includes lithography to leave material where the central conductor and the gap will be formed. Alternatively, an additive process forms mask layer 216, wherein a liftoff resist is disposed; mask layer 214 is deposited, and subsequently a selected portion of mask layer 214 is removed, leaving mask 216.

Removing a portion of central conductor layer 210 includes etching to remove material of the central conductor layer but does not significantly remove mask layer. Here, an undercut is formed width widths W1 and W2.

Forming undercut 290 interposed between substrate 212 and mask 216 in response to removing the portion of central conductor layer 210 includes overetching the central conductor to leave a select amount of space on sides of the central conductor.

Forming central conductor 218 from central conductor layer 210 in response to removing the portion of central conductor layer 210 includes the remaining structure.

Disposing ground conductor layer 220 on mask 216 and substrate 212 such that inter-electrode gap (222, 224) is interposed between sidewalls (228, 230) of central conductor 218 and inner walls (238, 226) of ground conductor layer 220 includes blanket deposition of material such that the material does not contact the central conductor that is protected directionally by the undercut.

Removing a portion of ground conductor layer 220 disposed on mask 216 to expose a surface of mask 216 includes using a subtractive process that goes through the ground layer but does not go through the mask layer.

Forming ground plane conductor 236 from ground conductor layer 220 in response to removing the portion of ground conductor layer 220 includes leaving ground plane conductor 236.

Removing mask 216 includes removing material from ground plane 220 above the mask using a subtractive process that leaves the ground plane and central line intact. This exposes the mask material and it can be subsequently removed.

Disposing cross over layer 292 on ground plane conductor 220 includes leaving the ground plane layer 220 intact where the cross over is desired. The mask will then be removed wherever the ground plane has been removed. If it is desired to remove the mask under the crossover then a process, such as vapor etching, can be used to remove that material selectively.

Forming cross over 270, from cross over layer 292, disposed on ground plane conductor 220 in response to removing the portion of cross over layer 292 includes adding more ground plane material on the structure and selectively removing material via a liftoff or subtractive process to leave cross over 270.

Self-aligned waveguide 200 has numerous beneficial uses, including delivering DC and RF signals, being a resonator, and the like. To deliver a DC or RF signal, the waveguides are connected on an input side ohmically, inductively, or capacitively to a signal. As a resonator, the waveguide is capacitively coupled to form a quarter-wave or half-wave resonator and can be ohmically, capacitively, or inductively coupled to an excitation source at an end of the waveguide.

In an embodiment, a process for performing quantum computing includes providing the waveguide as a superconducting low loss transmission line or resonator wherein the mask is removed and the waveguide includes a low loss substrate with the lines coupled to a two-level system such as a qubit.

Self-aligned waveguide 200 has numerous advantageous and beneficial properties. In an aspect, self-aligned waveguide 200 provides high yield for very long lines. Self-aligned waveguide 200 advantageously and unexpectedly provides very narrow gaps.

While one or more embodiments have been shown and described, modifications and substitutions may be made thereto without departing from the spirit and scope of the invention. Accordingly, it is to be understood that the present invention has been described by way of illustrations and not limitation. Embodiments herein can be used independently or can be combined.

Reference throughout this specification to "one embodiment," "particular embodiment," "certain embodiment," "an embodiment," or the like means that a particular feature, structure, or characteristic described in connection with the embodiment is included in at least one embodiment. Thus, appearances of these phrases (e.g., "in one embodiment" or "in an embodiment") throughout this specification are not necessarily all referring to the same embodiment, but may. Furthermore, particular features, structures, or characteristics may be combined in any suitable manner, as would be apparent to one of ordinary skill in the art from this disclosure, in one or more embodiments.

All ranges disclosed herein are inclusive of the endpoints, and the endpoints are independently combinable with each other. The ranges are continuous and thus contain every value and subset thereof in the range. Unless otherwise stated or contextually inapplicable, all percentages, when expressing a quantity, are weight percentages. The suffix "(s)" as used herein is intended to include both the singular and the plural of the term that it modifies, thereby including at least one of that term (e.g., the colorant(s) includes at least one colorants). "Optional" or "optionally" means that the subsequently described event or circumstance can or cannot occur, and that the description includes instances where the event occurs and instances where it does not. As used herein, "combination" is inclusive of blends, mixtures, alloys, reaction products, and the like.

As used herein, "a combination thereof" refers to a combination comprising at least one of the named constituents, components, compounds, or elements, optionally together with one or more of the same class of constituents, components, compounds, or elements.

All references are incorporated herein by reference.

The use of the terms "a" and "an" and "the" and similar referents in the context of describing the invention (especially in the context of the following claims) are to be construed to cover both the singular and the plural, unless otherwise indicated herein or clearly contradicted by context. "Or" means "and/or." Further, the conjunction "or" is used to link objects of a list or alternatives and is not disjunctive; rather the elements can be used separately or can be combined together under appropriate circumstances. It should further be noted that the terms "first," "second," "primary," "secondary," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

What is claimed is:

1. A process for making a self-aligned waveguide, the process comprising:

disposing a central conductor layer on a substrate, the central conductor layer comprising niobium and being electrically conductive;

disposing a mask layer on the central conductor layer such that the central conductor layer is interposed between the substrate and the mask layer;

forming a mask from the mask layer;

producing an exposed portion of the central conductor layer in response to forming the mask;

removing a portion of the central conductor layer;

forming an undercut interposed between substrate and the mask in response to removing a portion of the central conductor layer;

forming a central conductor from the central conductor layer in response to removing a portion of the central conductor layer, the central conductor bordering the undercut at a plurality of sidewalls of the central conductor, and the central conductor being interposed between the mask and the substrate;

disposing a ground conductor layer on the mask and the substrate such that an inter-electrode gap is interposed between the sidewalls of the central conductor and inner walls of the ground conductor layer, the ground conductor layer comprising niobium and being electrically conductive;

removing a portion of the ground conductor layer disposed on the mask to expose a surface of the mask;

forming a ground plane conductor from the ground conductor layer in response to removing the portion of the ground conductor layer; and removing the mask to make the self-aligned waveguide in which the undercut provides self-alignment of each of the inner walls of the ground plane conductor to each of the sidewalls of the central conductor, and the ground plane conductor is electrically isolated from the central conductor.

2. The process of claim 1, further comprising:

forming, prior to removing the portion of the ground conductor layer disposed on the mask to expose the surface of the mask, an intra-electrode gap in the ground plane conductor in response to removing the portion of the ground conductor layer.

3. The process of claim 1, further comprising:

forming, after removing the portion of the ground conductor layer disposed on the mask to expose the surface of the mask, an intra-electrode gap in the ground plane conductor in response to removing the portion of the ground conductor layer.

4. The process of claim 1, further comprising:

disposing a cross over layer on the ground plane conductor, the cross over layer comprising niobium and being electrically conductive.

5. The process of claim 4, further comprising:

removing a portion of the cross over layer;

forming a cross over, from the cross over layer, disposed on the ground plane conductor in response to removing the portion of the cross over layer.

6. The process of claim 5, wherein:

the cross over interconnects a first rail of the ground plane conductor and a second rail of the ground plane conductor such that the first rail, the second rail, and the cross over are in electrical communication.

7. The process of claim 1, wherein the ground plane conductor further comprises nitrogen, titanium, or a combination comprising at least one of the foregoing elements.

8. The process of claim 1, wherein the central conductor further comprises nitrogen, titanium, or a combination comprising at least one of the foregoing elements.

9. The process of claim 1, wherein the ground plane conductor further comprises nitrogen, titanium, or a combination comprising at least one of the foregoing elements.

10. The process of claim 1, wherein the substrate comprises silicon.

11. The process of claim 1, wherein the mask comprises silicon, oxygen, or a combination comprising at least one of the foregoing elements.

12. The process of claim 1, wherein the cross over comprises nitrogen, titanium, or a combination comprising at least one of the foregoing elements.

* * * * *